US010711565B2

(12) United States Patent
Billingham et al.

(10) Patent No.: US 10,711,565 B2
(45) **Date of Patent: *Jul. 14, 2020**

(54) SYSTEMS AND METHODS FOR REMEDIATING A MICROANNULUS IN A WELLBORE

(71) Applicant: Schlumberger Technology Corporation, Sugar Land, TX (US)

(72) Inventors: Matthew Edward Billingham, Paris (FR); Ram Sunder Kalyanraman, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/396,925

(22) Filed: Apr. 29, 2019

(65) Prior Publication Data

US 2019/0249517 A1 Aug. 15, 2019

Related U.S. Application Data

(63) Continuation of application No. 15/954,944, filed on Apr. 17, 2018, now Pat. No. 10,273,778.

(Continued)

(51) Int. Cl.

| | |
|---|---|
| ***E21B 33/138*** | (2006.01) |
| ***E21B 36/00*** | (2006.01) |
| ***E21B 43/116*** | (2006.01) |

(52) U.S. Cl.

CPC ..... *E21B 33/138* (2013.01); *E21B 36/008* (2013.01); *E21B 43/116* (2013.01)

(58) Field of Classification Search

None

See application file for complete search history.

(56) References Cited

U.S. PATENT DOCUMENTS 3,029,195 A * 4/1962 Marsh ..... E21B 41/02 166/303
5,127,473 A * 7/1992 Harris ..... C04B 7/527 166/277

(Continued)

FOREIGN PATENT DOCUMENTS

EP 1866518 A1 12/2007
WO 2016049424 A1 3/2016

OTHER PUBLICATIONS

Search and Examination Report issued in the related GB Application 1806266.1, dated Sep. 5, 2018 (7 pages).

(Continued)

*Primary Examiner* — Anuradha Ahuja
(74) *Attorney, Agent, or Firm* — Eileen Pape

(57) ABSTRACT

A method for remediating a microannulus in a cased wellbore may include conveying a downhole tool into the cased wellbore to a location of interest. The location of interest may include one or more perforations in a casing and a microannulus. The downhole tool may include a heat generation device. The method may also include activating the heat generation device to melt a fill material at the location of interest such that the fill material flows through the perforations into one or more voids, including the microannulus, in or around cement disposed between the casing and the cased wellbore. Additionally, the method may include deactivating the heat generation device to facilitate solidification of the fill material in the one or more voids and sealing of the microannulus.

16 Claims, 4 Drawing Sheets

Related U.S. Application Data

(60) Provisional application No. 62/486,205, filed on Apr. 17, 2017.

(56) References Cited

U.S. PATENT DOCUMENTS 6,237,688 B1 * 5/2001 Burleson ..... E21B 29/02 166/281
6,384,389 B1 * 5/2002 Spencer ..... E21B 33/13 166/304
6,695,058 B1 * 2/2004 French ..... E21B 21/002 166/173
6,828,531 B2 * 12/2004 Spencer ..... E21B 33/13 219/635
7,562,710 B2 * 7/2009 Buchanan ..... E21B 33/134 166/288
2002/0170713 A1 * 11/2002 Haugen ..... E21B 7/061 166/298
2006/0144591 A1 * 7/2006 Gonzalez ..... E21B 29/10 166/277
2007/0051514 A1 * 3/2007 La Rovere ..... E21B 29/10 166/277
2008/0190612 A1 * 8/2008 Buchanan ..... E21B 33/134 166/288
2009/0173500 A1 * 7/2009 Orban ..... E21B 33/138 166/298
2011/0036570 A1 * 2/2011 La Rovere ..... E21B 33/138 166/277
2011/0147015 A1 * 6/2011 Mickey ..... E21B 23/03 166/387
2012/0085539 A1 4/2012 Tonnessen et al.
2014/0305635 A1 * 10/2014 Linetskiy ..... E21B 43/24 166/248
2018/0148991 A1 * 5/2018 Hearn ..... E21B 33/12
2018/0298720 A1 10/2018 Billingham et al.

OTHER PUBLICATIONS

Examination Report issued in the related GB Application 1806266.1, dated Jan. 22, 2020 (3 pages).

* cited by examiner

SYSTEMS AND METHODS FOR REMEDIATING A MICROANNULUS IN A WELLBORE

CROSS REFERENCE TO RELATED APPLICATION

This application is a continuation of co-pending U.S. patent application Ser. No. 15/954,944, entitled "Systems and Methods for Remediating a Microannulus in a Wellbore," filed Apr. 17, 2018, which claims priority to U.S. Provisional Patent Application No. 62/486,205, entitled "Method to Remediate Cement Issues with Downhole Castable Alloys," filed Apr. 17, 2017, which is herein incorporated by reference in its entirety for all purposes.

BACKGROUND

This disclosure relates generally to wellbore operations, and, more specifically, to remediating cement issues in wellbore operations.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

A wellbore drilled into a geological formation may be targeted to produce oil and/or gas from certain zones of the geological formation. In some scenarios, to prevent geological zones (e.g., at different depths) from interacting with one another via the wellbore, and to prevent fluids from undesired zones from entering the wellbore, a cylindrical casing may be placed into the wellbore. Additionally, the cylindrical casing may be cemented in place by depositing cement between the cylindrical casing and a wall of the wellbore. As such, during cementing, cement may be injected into the open annulus formed between the cylindrical casing and the geological formation (i.e., the wall of the wellbore). When the cement properly sets, fluids from one zone of the geological formation may not be able to pass through the wellbore to interact with another zone. This desirable condition may be referred to as "zonal isolation."

In general, the cement maintains the pressure integrity of the well throughout the life of the well. However, complications in the integrity of this pressure barrier may occur during the initial cementing or over time during operation of the well. For example, pockets and/or cracks may be created within the cement that provide a means for undesirable mud/fluid flow. Additionally, in certain circumstances, a microannulus between the cement and the casing or between the cement and the wall of the geological formation may form, possibly leading to undesirable fluid flow between zones.

SUMMARY

A summary of certain embodiments disclosed herein is set forth below. These aspects are presented merely to provide the reader with a summary of these certain embodiments and that these aspects are not intended to limit the scope of this disclosure. Indeed, this disclosure may encompass a variety of aspects that may not be set forth below.

In one embodiment, a method for remediating a microannulus in a cased wellbore may include conveying a downhole tool into the cased wellbore to a location of interest. The location of interest may include one or more perforations in a casing and a microannulus. The downhole tool may include a heat generation device. The method may also include activating the heat generation device to melt a fill material at the location of interest such that the fill material flows through the perforations into one or more voids, including the microannulus, in or around cement disposed between the casing and the cased wellbore. Additionally, the method may include deactivating the heat generation device to facilitate solidification of the fill material in the one or more voids and sealing of the microannulus.

In another embodiment, a method for remediating a microannulus in a wellbore may include perforating, via a downhole tool, a casing, a cement wall, a wellbore wall, or a combination thereof to create one or more perforations into a geological formation at a location of a microannulus. The method may also include melting, via the downhole tool, an alloy adjacent to the one or more perforations such that molten alloy flows through the one or more perforations and into the microannulus. Additionally, the method may include cooling the molten alloy to solidify in place to seal the microannulus and removing excess alloy from within the casing at the location.

In another embodiment, a system for remediating a microannulus in a wellbore may include a conveyance device to convey at least a fill material and a heat generation device into a cased wellbore extending into a geological formation to a location of interest, which may include a microannulus. Additionally, the heat generation device may melt the fill material such that the fill material flows into one or more perforations in a casing of the cased wellbore at the location of interest to seal the microannulus and to at least partially restore zonal isolation.

BRIEF DESCRIPTION OF THE DRAWINGS

Various aspects of this disclosure may be better understood upon reading the following detailed description and upon reference to the drawings in which.

DETAILED DESCRIPTION

Figure 1:
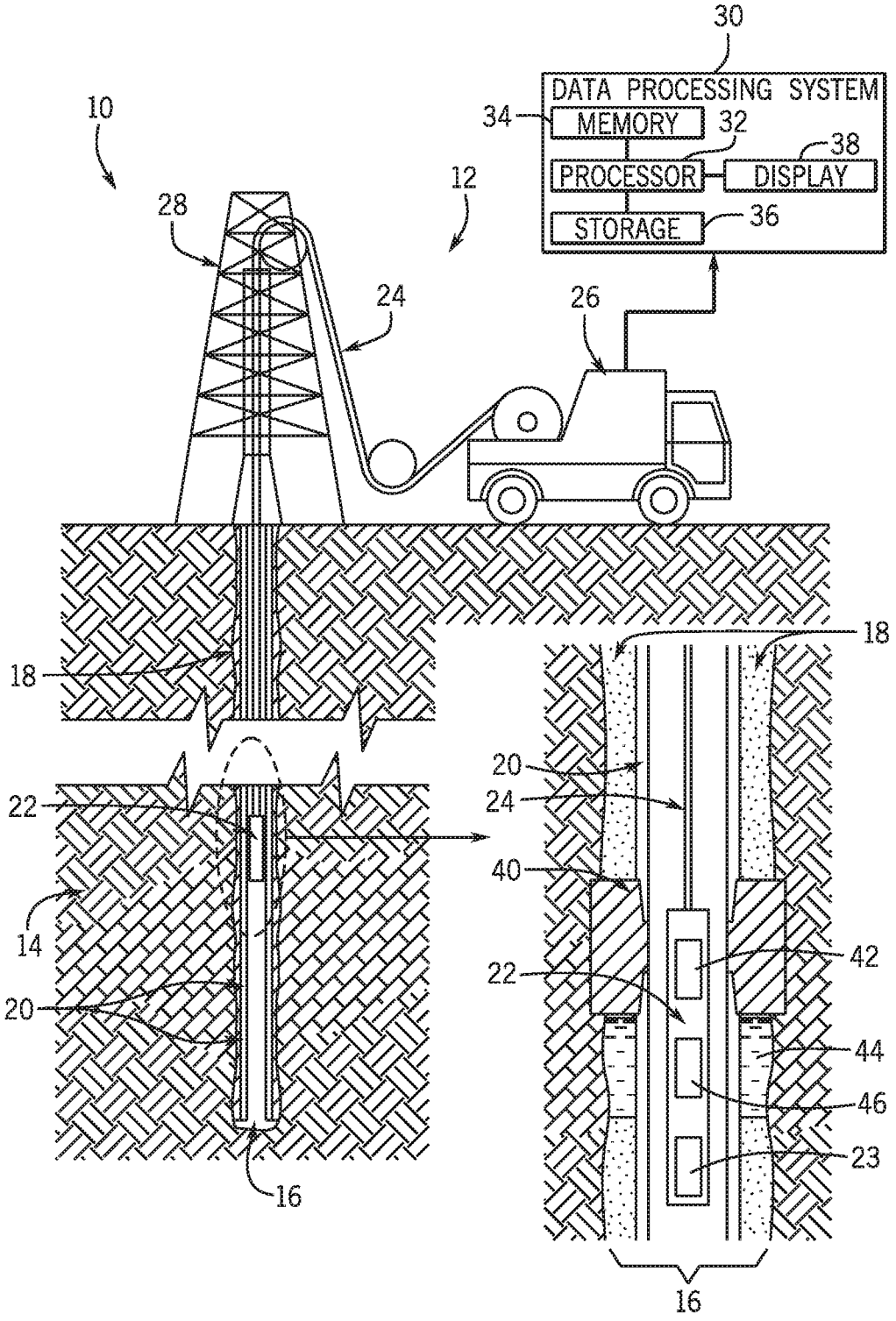
FIG. 1 is a schematic diagram of a wellbore operations system including a downhole tool, in accordance with an embodiment.

One or more specific embodiments of the present disclosure will be described below. These described embodiments are examples of the presently disclosed techniques. Additionally, to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, references to "one embodiment" or "an embodiment" of the present disclosure are not intended to be interpreted as excluding the existence of additional embodiments that also incorporate the recited features.

The oil and gas industry includes a number of sub-industries, such as exploration, drilling, logging, extraction, transportation, refinement, retail, and so forth. During exploration and drilling, boreholes may be drilled into the ground for reasons that may include discovery, observation, or extraction of resources. These resources may include oil, gas, water, or any combination of elements within the ground.

Wellbores, sometimes called boreholes, may be straight or curved holes drilled into the ground from which resources may be discovered, observed, and/or extracted. The creation of a wellbore may consist of boring through a geological formation using a drill and a multitude of sensors that measure and/or monitor the drilling process. Additionally, a wellbore drilled into a geological formation may employ a casing to prevent geological zones, for example those at different depths, from interacting with one another via the wellbore. Casing a wellbore may assist in preventing the undesirable mixing of fluids and/or muds from different geological zones the wellbore may contact, as well as provide other desirable attributes.

To case the wellbore, a cylindrical (e.g., tubular) casing may be placed into the wellbore. Additionally, the casing may be cemented in place by injecting cement into the open annulus formed between the cylindrical casing and the wall of the wellbore/geological formation. The cement may provide multiple functions, such as holding the casing in place and providing a pressure barrier preventing leakage of fluids (e.g., water, oil, gas, etc.) from one geological zone to another, including the surface. When the cement properly sets, fluids from one geological zone of the formation may not be able to pass through the wellbore to interact with another zone (e.g., zonal isolation).

In some scenarios, complications in the integrity of the pressure barrier formed by the cement may occur during the initial cementing or over time. For example, pockets and/or cracks may be created within the cement that provide a means for undesirable fluid flow or reduced pressure integrity. Additionally, a microannulus between the cement and the casing or between the cement and the wall of the formation may form, possibly leading to undesirable fluid flow between zones.

A microannulus may be defined as a circumferential or partially circumferential gap between the casing and cement or between the cement and the wall of the formation. The gap of the microannulus may be, for example, less than 5 microns (μm), less than 10 μm, less than 100 μm, or less than 10 millimeters. A microannulus may come about due to any of a number of potential causes, such as movement of the casing relative to the cement, thermal expansion and contraction of the casing, the cement, and/or the formation, and/or pressure differences between the casing, the cement, and/or the formation. In some scenarios, a microannulus may jeopardize the integrity of the zonal isolation. Certain techniques to remedially squeeze or place cement or resins into locations of a microannulus may entail large amounts of time and resources. Additionally, such techniques, such as a cement squeeze technique, may temporarily expand the diameter of the casing, causing the microannulus to close at least partially while cement and/or resin is attempting to fill the microannulus. As such, when the process is stopped, the casing may return to a smaller diameter, and the microannulus may reopen.

In certain embodiments described herein, however, a downhole tool may be used to melt a fill material at a location of a microannulus (e.g., at a given depth of the wellbore) to fill and seal the microannulus, thereby re-establishing zonal isolation, without undergoing a potentially resource-intensive process. In one such embodiment, a downhole tool including a heat generation device and a fill material may be conveyed into the casing to the location of the microannulus. The heat generation device may then melt the fill material such that the molten fill material flows through perforations through the casing and into the microannulus, into cracks in the cement, and/or into pockets in the wall of the wellbore (e.g., into the geological formation). The fill material may then, for example, solidify and plug the microannulus, as well as the cracks in the cement, and the pockets in the wall of the wellbore. The perforations in the casing may also be sealed, and zonal isolation may be restored.

With the foregoing in mind, FIG. 1 schematically illustrates a system 10 for filling and/or sealing a microannulus in a cased wellbore. In certain embodiments, the system 10 may include surface equipment 12 above a geological formation 14 to facilitate operations within a wellbore 16. In addition, cement 18, and/or other suitable materials, may seal a space between the wellbore 16 and a casing 20 that has been installed into the wellbore 16. In certain embodiments, the casing 20 may include multiple sections coupled via collars, and may be made of carbon steel, stainless steel, or other suitable materials to withstand a variety of forces such as those found in a downhole environment.

In certain embodiments, the surface equipment 12 may carry out various well logging operations to detect conditions of the wellbore 16. The well logging operations may measure parameters of the geological formation 14 (e.g., resistivity or porosity) and/or the wellbore 16 (e.g., temperature, pressure, fluid type, or fluid flowrate). Other measurements may provide well-logging data relating to characteristics of the cement 18 (e.g., measurements of characteristic radiation emitted by a material in the cement 18, such as boron or gadolinium added as a dopant, sonic measurements, etc.) that may be used to verify the cement 18 installation and the zonal isolation of the wellbore 16. In certain embodiments, a downhole tool 22 may be run into the casing 20, and may include an analysis tool 23 to obtain such measurements to locate a microannulus and/or other abnormalities, as well as the means to remediate them, as described in greater detail herein. The local identification of a microannulus, or a likelihood thereof, may instigate the use of the downhole tool 22 to seal the identified microannulus. As such, the downhole tool 22 may function as a conveyance device for the various tools.

In certain embodiments, the downhole tool 22 may be conveyed through the wellbore 16 by a cable 24. Such a cable 24 may be a mechanical cable, an electrical cable, or an electro-optical cable that includes a fiber line protected against the harsh environment of the wellbore 16. In other embodiments, however, the downhole tool 22 may be conveyed using any other suitable conveyance, such as coiled tubing or a slickline. In certain embodiments, the downhole tool 22 may be deployed inside the wellbore 16 by the surface equipment 12, which may include a vehicle 26 and a deploying system, such as a drilling rig 28. Data related to the geological formation 14, the wellbore 16, and/or an operation of the downhole tool 22 may be transmitted to the surface (e.g., via the cable 24), and/or stored in the downhole tool 22 for later processing and analysis. In certain embodiments, the vehicle 26, the downhole tool 22, or a separate interface may be fitted with or may communicate with a computer and utilize software to perform data collection, analysis, and/or operation of the downhole tool 22.

To assist in wellbore operations, such as the deployment and use of the downhole tool 22, the system 10 may also include a data processing system 30 that includes a processor 32, memory 34, storage 36, and/or a display 38. In other embodiments, the wellbore operations may be processed by a similar data processing system 30 at any other suitable location (e.g., within the downhole tool 22, offsite, etc.). The processor 32 may execute instructions stored in the memory 34 and/or storage 36. As such, the memory 34 and/or the storage 36 of the data processing system 30 may be any suitable article of manufacture that can store the instructions. The memory 34 and/or the storage 36 may be ROM memory, random-access memory (RAM), flash memory, an optical storage medium, or a hard disk drive, to name a few examples. The display 38 may be any suitable electronic display that can display logs and/or other information relating to the wellbore operations.

FIG. 1 also schematically illustrates a magnified view of a portion of the cased wellbore 16. As stated above, the downhole tool 22 may generate a filled and/or sealed area 40 that may include portions of the casing 20, the cement 18, and/or the geological formation 14 (e.g., the wall of the wellbore 16). To accomplish this, a sealing tool 42 may be activated to melt a fill material into perforations 44 through the casing 20 and the cement 18 and into the geological formation 14. The perforations 44 may include naturally occurring and/or intentionally created (e.g., via perforating tools) voids through the casing 20, the cement 18, and/or the wall of the wellbore 16. In certain embodiments, a perforating tool 46 (e.g., perforating gun) may be deployed into the wellbore 16 to create such perforations 44, for example, by employing bullet perforation, jet perforations, or abrasion jetting, that are directed toward the casing 20. Such perforations may be calibrated to perforate through the casing 20, the cement 18, and into the geological formation 14. Additionally, perforations may also be calibrated to penetrate to a shallower or deeper depth depending on the particular implementation and/or the location of a microannulus, for example, as determined from an analysis tool 23. As illustrated in FIG. 1, in certain embodiments, the downhole tool 22 may include both the perforating tool 46 and the sealing tool 42. However, the perforating tool 46 and the sealing tool 42 may also be utilized as separate downhole tools 22 placed into the wellbore 16 separately or simultaneously via the same cable 24.

Figure 2:
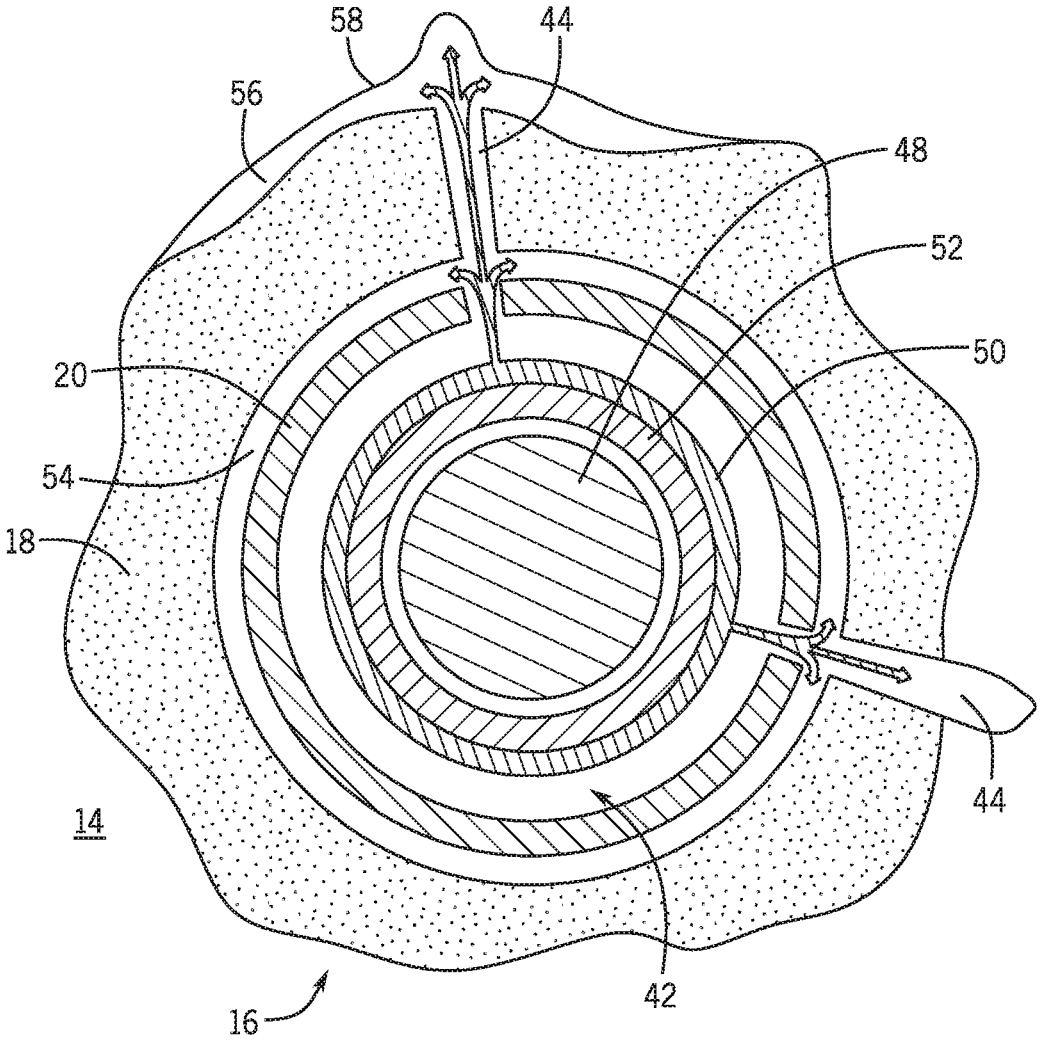
FIG. 2 is a schematic diagram of a cross-sectional top view of a sealing device disposed in a geological formation, in accordance with an embodiment.

To help illustrate the techniques described herein, FIG. 2 is a schematic diagram of a cross-sectional top view of a sealing tool 42 including a heat generating device 48 and a fill material 50 in a geological formation 14. In certain embodiments, the fill material 50 may be coated (e.g., plated) onto an exterior of a sleeve 52 (e.g., a tubular sleeve, in certain embodiments) between the heat generating device 48 and the casing 20. However, in other embodiments, the sealing tool 42 may be implemented without a sleeve 52, such that the fill material 50 is coated directly onto the heat generating device 48. When in operation, the heat generating device 48 may melt the fill material 50, causing the fill material 50 to flow into perforations 44 through the casing 20 and the cement 18 and into a wall 58 of the wellbore 16.

In addition, if any microannuli 54, 56 exist (e.g., a microannulus 54 between the casing 20 and the cement 18 or a microannulus 56 between the cement 18 and the wall 58 of the wellbore 16) that are fluidly connected to the perforations, the fill material 50 will flow into the microannuli 54, 56. In certain embodiments, the microannulus 54 may exist between the casing 20 and the cement 18, or the microannulus 56 may exist between the cement 18 and the wall 58 of the wellbore 16. As such, in certain embodiments, the fill material 50 may flow all the way from inside the casing 20 to the wall 58 of the wellbore 16. Depending on the particular situation, the microannulus 54, 56 may complete a full circle (e.g., as does the illustrated microannulus 54, which extends circumferentially around the entire exterior of the casing 20 between the casing 20 and the cement 18) or may be formed as a partial microannulus 54, 56 that extends only partially circumferentially (e.g., as does the illustrated microannulus 56 between the cement 18 and the wall 58 of the wellbore 16).

In certain embodiments, the fill material 50 may be any material suitable for being melted and flowing into gaps in the wellbore 16, as well as creating a sufficient seal. For example, in certain embodiments, the fill material 50 may include a polymer, metal, or metal alloy. As a further example, in certain embodiments, such metal alloys may include a bismuth-tin alloy (e.g., between approximately 80% and approximately 95% bismuth and between approximately 5% and approximately 20% tin, between approximately 85% and approximately 90% bismuth and between approximately 10% and approximately 15% tin, or approximately 88% bismuth and approximately 12% tin) or a bismuth-silver alloy (e.g., between approximately 95% and approximately 99% bismuth and between approximately 1% and approximately 5% silver, or approximately 98% bismuth and 2% silver). In general, the fill material 50 may have a sufficiently low fluid viscosity when molten such that the molten fill material 50 may fill and seal crevices and voids such as a microannulus 54, 56. Additionally, certain fill materials 50 (e.g., a bismuth alloy) may expand when solidifying from the molten state. As such, this may yield a compression fit to assist in generating an improved seal.

To melt the fill material 50, the heat generating device 48 may employ one or more methods for generating heat. For example, in certain embodiments, the heat generating device 48 may include a resistor, nichrome wire, a chemical heater unit, an electric heater unit, other known heating devices or elements, or a combination thereof. In certain embodiments, the heat generating device 48 includes a chemical heater and an initiator (e.g., an electronic initiator). In one such embodiment, thermite may be used in a chemical reaction to reach a relatively high temperature (e.g., greater than approximately 3500 degrees Fahrenheit, such as approximately 3500 degrees Fahrenheit, approximately 3700 degrees Fahrenheit, approximately 4000 degrees Fahrenheit, or any other suitable temperature) to melt the fill material 50. The heat generating device 48 may be any suitable heat generator capable of melting an appropriate fill material 50.

Figure 3:
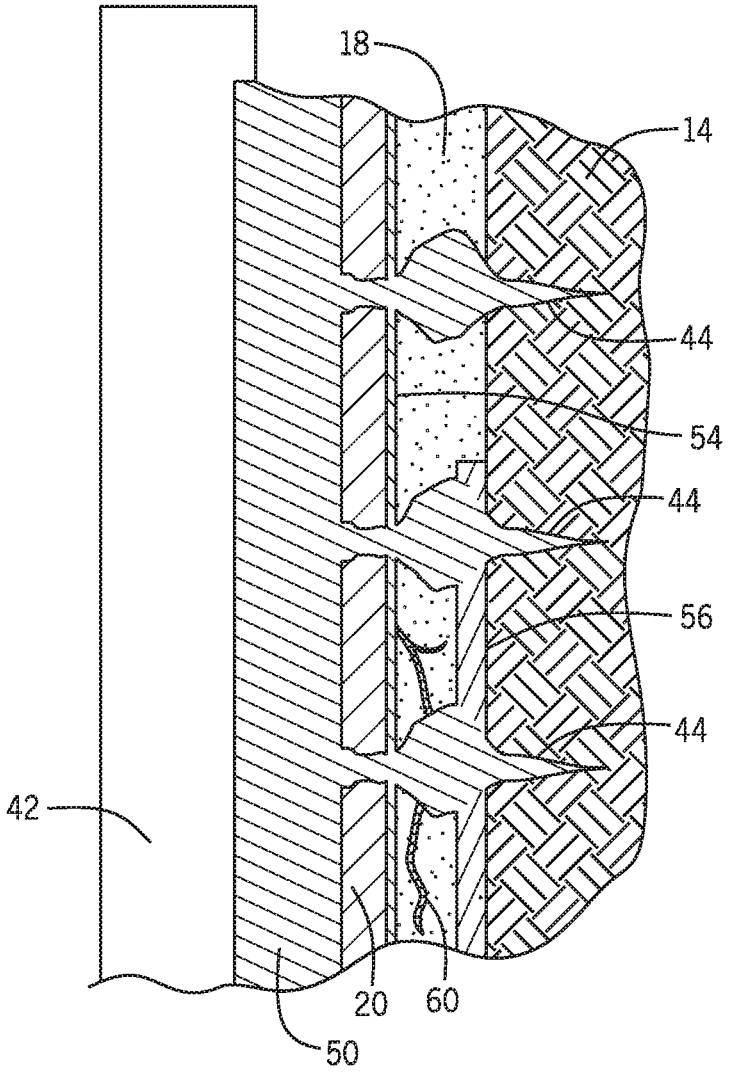
FIG. 3 is a schematic diagram of a cross-sectional side view of a sealing device disposed in a geological formation, in accordance with an embodiment.

To help further illustrate the present techniques, FIG. 3 is a schematic diagram of a cross-sectional side view of a sealing tool 42 melting the fill material 50 and sealing one or more microannuli 54, 56. As discussed above, the sealing tool 42 may melt the fill material 50 (e.g., metal alloy) and allow the molten fill material 50 to flow into the perforations 44 through the casing 20, the cement 18, and/or the wall 58 of the wellbore 16 to fill and seal a microannulus 54 between the casing 20 and the cement 18 and/or a microannulus 56 between the cement 18 and the wall 58 of the wellbore 16. In certain embodiments, the molten fill material 50 may additionally fill cracks 60 and/or other pockets in the cement 18.

Once the molten fill material 50 has been deposited into the perforations 44 and the microannulus 54, 56, the heat generation device 48 may be deactivated. In certain embodiments, such as those including a chemical reaction, deactivation may entail the end of the reaction, or the slowing thereof to an ineffectual rate for melting the fill material 50, after the reactants have been expended. As such, in certain embodiments, the heat generation device 48 may deactivate passively. With the heat generation device 48 deactivated, the fill material 50 may cool and solidify in a perforation 44, a microannulus 54, 56, and/or a crack 60 in the cement 18 and form a seal between geological zones. In certain embodiments, cooling the molten fill material 50 may include the deactivation of the heat generation device 48, active cooling of the molten fill material 50, or a combination thereof. Additionally, in some scenarios, fill material 50 may also cool and solidify within the casing 20.

Depending on implementation, fill material 50 within the casing 20 after sealing has been completed may be undesirable. As such, in certain embodiments, a material removal device may be implemented in the downhole tool 22 to remove excess fill material 50 from within the casing 20. Such removal may leave the interior of the casing 20 relatively smooth with approximately a same interior diameter as before the sealing process. This may allow the conveyance of other tools or fluids without possible hindrance. As with the perforating tool 46, the material removal device may be implemented on the downhole tool 22 along with the sealing tool 42, separately from the sealing tool 42 but conveyed by the same cable 24 (e.g., on the same tool string), or used separately without the sealing tool 42 in the wellbore 16. In certain embodiments, the downhole tool 22 or a downhole tool string includes the sealing tool 42, a perforating tool 46, an analysis tool 23, and a material removal device. Furthermore, the arrangement of such tools and devices together as a single downhole tool 22 or on a tool string may be organized depending on that particular implementation.

In certain embodiments, the material removal device may include a milling tool to grind, drill, and/or scrape the excess fill material 50 from within the casing 20. Additionally or alternatively, the material removal device may include a heat generation device 48 to re-melt the fill material 50 within the casing 20. In certain embodiments, the heat generation device 48 utilized by the material removal device may be the same heat generation device 48 of the sealing tool 42 or a separate and/or different heat generation device 48. In some scenarios, care may be taken to prevent re-melting or disturbing of the fill material 50 deposited in the perforation(s) 44, the microannuli 54, 56, or other desirable location.

Figure 4:
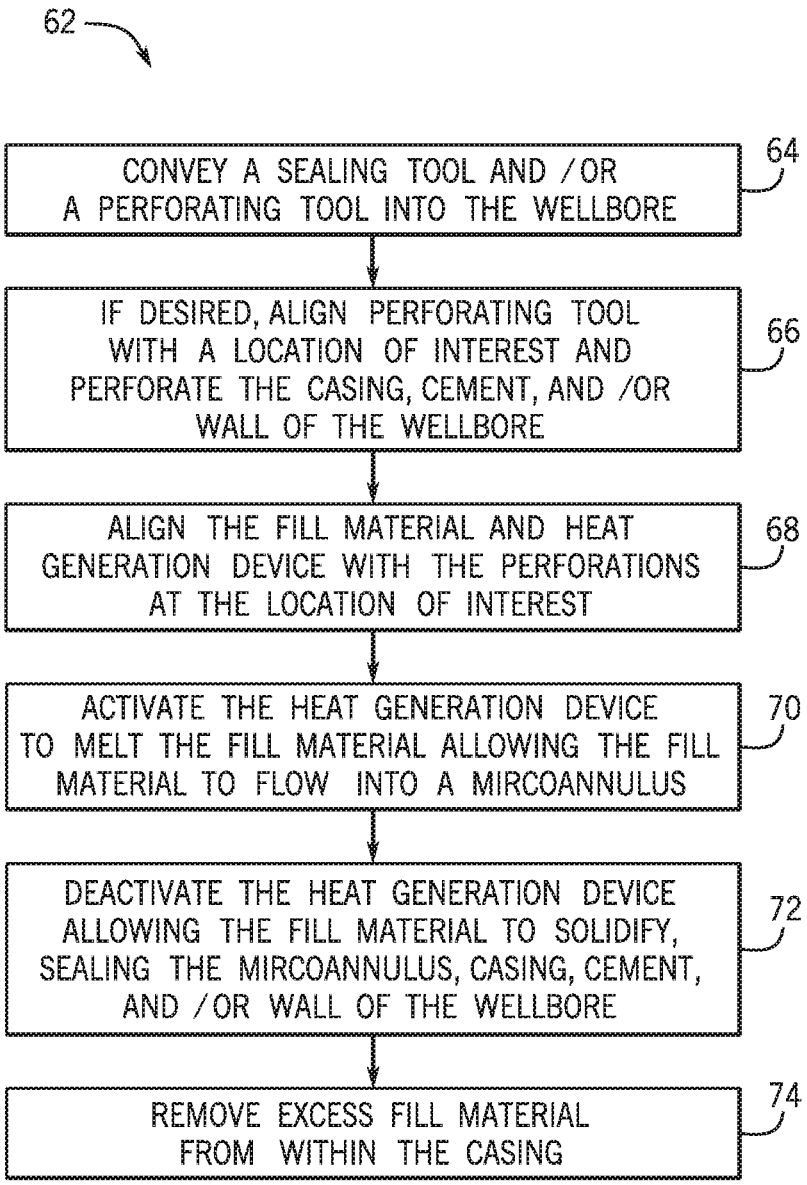
FIG. 4 is a flowchart, in accordance with an embodiment.

In further illustration of the present techniques, FIG. 4 is a flowchart 62 depicting a process of filling and/or sealing a microannulus 54 in a cased wellbore 16. The sealing tool 42 and/or the perforating tool 46 may be first be conveyed into the wellbore 16 (process block 64). As discussed above, the perforating tool 46 may be used separately, in conjunction with, or simultaneously with the sealing tool 42. If perforations 44 have not already been created when the sealing tool 42 is conveyed into the wellbore 16, the perforating tool 46 may be aligned with a location of interest (e.g., a location, depth, and or direction where a microannulus 54, 56 may exist) and activated to perforate the casing 20, the cement 18, and/or the wall 58 of the wellbore 16 (process block 66). In certain embodiments, the location of interest may be determined by the analysis tool 23 using one or more sensors. With the perforations 44 in place, the fill material 50 and the heat generation device 48 of the sealing tool 42 may be aligned with the perforations 44 at the location of interest (process block 68). The heat generation device 48 may be activated to melt the fill material 50, allowing the fill material 50 to flow into a microannulus 54, 56 via one or more perforation(s) 44 (process block 70). When the heat generation device 48 is deactivated (e.g., actively or passively), the fill material 50 may be allowed to solidify, sealing the microannulus 54, 56, the casing 20, the cement 18, and/or the wall 58 of the wellbore 16 (process block 72). In certain embodiments, excess fill material 50 may then be removed from within the casing 20 (process block 72), for example, via the material removal device described herein.

The specific embodiments described above have been shown by way of example, and these embodiments may be susceptible to various modifications and alternative forms. It should be further understood that the claims are not intended to be limited to the forms disclosed, but rather to cover suitable modifications, equivalents, and alternatives.

The invention claimed is:

1. A method comprising:

conveying a downhole tool into a cased wellbore to a location of interest, wherein the location of interest includes one or more perforations in a casing and a microannulus, wherein the downhole tool comprises a heat generation device and a fill material removal device;

activating the heat generation device to melt a fill material at the location of interest such that the fill material flows through the one or more perforations into one or more voids in or around cement disposed between the casing and the cased wellbore, wherein the one or more voids comprises the microannulus;

deactivating the heat generation device to facilitate solidification of the fill material in the one or more voids and sealing of the microannulus, and solidification of a portion of excess fill material within the casing at the location of interest; and activating the fill material removal device to remove the portion of excess fill material by re-melting the portion of excess fill material with the heat generation device.

2. The method of claim 1, comprising perforating the casing and the cement to create the one or more perforations.

3. The method of claim 2, wherein creating the one or more perforations comprises firing a perforating gun at the casing from inside the casing.

4. The method of claim 2, comprising positioning, after the one or more perforations are created, the downhole tool such that the heat generation device is aligned with the one or more perforations.

5. The method of claim 2, wherein the downhole tool is a first downhole tool, and wherein the one or more perforations are created with a second downhole tool, wherein a single tool string comprises the first downhole tool and the second downhole tool.

6. The method of claim 1, wherein the fill material expands upon solidification.

7. The method of claim 1, wherein the heat generation device comprises thermite.

8. The method of claim 1, wherein removing the portion of excess fill material comprises milling, grinding, drilling, scraping, or a combination thereof, the portion of excess fill material from within the casing.

9. The method of claim 1, wherein removing the portion of excess fill material further comprises clearing and smoothing an interior surface of the casing at the location of interest.

10. The method of claim 1, wherein sealing the microannulus comprises at least partially re-establishing zonal isolation within the cased wellbore.

11. The method of claim 1, comprising conveying the fill material and the heat generation device into the cased wellbore using a wireline, cable, slickline, e-line, coiled tubing, or a combination thereof.

12. A method comprising:

conveying a downhole tool into a cased wellbore to a location of interest, wherein the location of interest includes one or more perforations in a casing and a microannulus, wherein the downhole tool comprises a heat generation device and a fill material removal device;

activating the heat generation device to melt a fill material at the location of interest such that the fill material flows through the one or more perforations into one or more voids in or around cement disposed between the casing and the cased wellbore, wherein the one or more voids comprises the microannulus;

deactivating the heat generation device to facilitate solidification of the fill material in the one or more voids and sealing of the microannulus, and solidification of a portion of excess fill material within the casing at the location of interest; and activating the fill material removal device to remove the portion of excess fill material by re-melting the portion of excess fill material with a different heat generation device.

13. The method of claim 12, wherein the fill material expands upon solidification.

14. The method of claim 12, wherein removing the portion of excess fill material further comprises clearing and smoothing an interior surface of the casing at the location of interest.

15. The method of claim 12, wherein sealing the microannulus comprises at least partially re-establishing zonal isolation within the cased wellbore.

16. The method of claim 12, comprising conveying the fill material and the heat generation devices into the cased wellbore using a wireline, cable, slickline, e-line, coiled tubing, or a combination thereof.

* * * * *